United States Patent [19]

Hara et al.

[11] 4,262,294

[45] Apr. 14, 1981

[54] ELECTROSTATIC PRINTING APPARATUS COMPRISING IMPROVED ELECTRODE DRIVE MEANS

[75] Inventors: Kazuyuki Hara; Mitsuru Kondo; Takeshi Kamada; Noboru Furukawa; Tamio Ohori, all of Tokyo, Japan

[73] Assignee: Ricoh Company, Ltd., Tokyo, Japan

[21] Appl. No.: 929,266

[22] Filed: Jul. 31, 1978

[30] Foreign Application Priority Data

Aug. 9, 1977 [JP] Japan ..... 52-95439

[51] Int. Cl.[3] ..... G03G 15/044

[52] U.S. Cl. ..... 346/155; 346/154

[58] Field of Search ..... 340/153, 154, 155

[56] References Cited

U.S. PATENT DOCUMENTS

| | | | |
|---|---|---|---|
| 2,997,361 | 8/1961 | Christopherson | 346/154 |
| 3,157,456 | 11/1964 | Kikuchi | 346/154 |
| 3,624,661 | 11/1971 | Shebanow | 346/155 |
| 3,653,065 | 3/1972 | Brown, Jr. | 340/154 |
| 3,797,021 | 3/1974 | Hida | 346/154 |
| 3,798,609 | 3/1974 | Frohbach | 346/154 |
| 4,157,553 | 6/1979 | Diddens | 346/153 |

*Primary Examiner*—Stuart N. Hecker

*Attorney, Agent, or Firm*—David G. Alexander

[57] ABSTRACT

A sheet of copy paper (24) is moved perpendicular to a linear array (22) of printing electrodes (221, 222, 223, 224 . . . ). The electrodes (221, 222, 223, 224 . . . ) are selectively energized to form an electrostatic charge pattern on the copy sheet (24) corresponding to one horizontal scan line of an original document. The electrostatic charge pattern is developed by a toner and the resulting toner image fixed to the copy sheet (24). The electrodes (221, 222, 223, 224 . . . ) are divided into a first set (221, 223, 225 . . . ) and a second set (222, 224, 226 . . . ), the electrodes in the second set (222, 224, 226 . . . ) being alternatingly spaced from the electrodes in the first set (221, 223, 225 . . . ) along the length of the array (22). The first set (221, 223, 225 . . . ) of electrodes are selectively energized during a first time period (t1) and the second set (222, 224, 226 . . . ) of electrodes are selectively energized during a subsequent second time period (t2). The second time period (t2) may be made longer than the first time period (t1) and/or a voltage (V2) applied to the second set (222, 224, 226 . . . ) of electrodes may be made higher than a voltage (V1) applied to the first set (221, 223, 225 . . . ) of electrodes.

10 Claims, 14 Drawing Figures

ELECTROSTATIC PRINTING APPARATUS COMPRISING IMPROVED ELECTRODE DRIVE MEANS

BACKGROUND OF THE INVENTION

The present invention relates to an electrostatic printing apparatus which may be used in a facsimile transmission system, electrostatic copying machine, data processing system or the like.

Such a printing apparatus generally comprises a linear array of printing electrodes which are selectively energized to apply an electrostatic charge pattern to a sheet of copy paper representing a scan line of an original document or the like. The copy sheet is incrementally moved to form a complete electrostatic image representing the entire original document. Then, a toner is applied to the copy sheet to develop the electrostatic image into a toner image which is fixed to the copy sheet to provide a permanent reproduction of the original document. Typically, one or more auxiliary electrodes are provided adjacent to the printing electrode array on either the same side or the opposite side of the copy sheet, the auxiliary electrodes being energized in a predetermined manner in combination with the printing electrodes.

Although such an apparatus is capable of high speed printing, a major problem has heretofore existed in the prior art regarding uneven printing density. This is generally due to the fact that the charge density induced on a copy sheet by a given printing electrode varies depending on the charge pattern. In other words, a particular printing electrode is influenced by the voltages applied to adjacent printing electrodes.

SUMMARY OF THE INVENTION

In accordance with the present invention a plurality of first printing electrodes are arranged in a first row. A plurality of second printing electrodes are arranged in a second row adjacent to the first printing electrodes, the second printing electrodes being alternatingly spaced from the first printing electrodes in a direction parallel to the first and second rows. Drive means selectively energize the first and second printing electrodes to form an electrostatic charge pattern on a printing medium disposed adjacent to the first and second printing electrodes, the drive means being constructed to energize selected first printing electrodes during a first time period and subsequently energize selected second printing electrodes during a second time period.

It is an object of the present invention to provide an electrostatic printing apparatus capable of even or uniform printing.

It is another object of the present invention to provide an electrostatic printing apparatus in which adjacent printing electrodes are alternatingly energized on a time division basis.

It is another object of the present invention to provide an electrostatic printing apparatus which eliminates the effect of adjacent printing electrodes on each other.

It is another object of the present invention to provide a generally improved electrostatic printing apparatus.

Other objects, together with the foregoing, are attained in the embodiments described in the following description and illustrated in the accompanying drawing.

DESCRIPTION OF THE PREFERRED EMBODIMENTS

While the electrostatic printing apparatus of the present invention is susceptible of numerous physical embodiments, depending upon the environment and requirements of use, substantial numbers of the herein shown and described embodiments have been made, tested and used, and all have performed in an eminently satisfactory manner.

Figure 2:
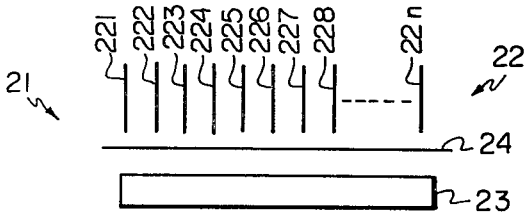
FIG. 2 is a schematic view showing another electrostatic printing apparatus.

Referring now to FIG. 2 of the drawing, an electrostatic apparatus is generally designated by the reference numeral 21 and comprises a linear array 22 of printing electrodes in the form of needles or styluses. The individual electrodes are designated as 221, 222 . . . 22n respectively. Although arranged in a row, the electrodes 221, 222 . . . 22n are electrically insulated from each other.

A sheet of copy paper 24 is disposed between the ends of the electrodes 221, 222 . . . 22n and an auxiliary electrode 23. To form a linear electrostatic charge pattern on the copy sheet 24, a voltage of typically +300 VDC is applied to the auxiliary electrode 23. In accordance with the desired charge pattern, voltages of typically −300 VDC are applied to selected ones of the electrodes 221, 222 . . . 22n. An electrostatic charge point is formed on the copy sheet 24 between the auxiliary electrode 23 and an electrode 221, 222 . . . 22n which is energized with −300 VDC, since the total potential difference across the copy sheet 24 in such an area is |600 VDC|. However, no electrostatic charge point will be formed between the auxiliary electrode 23 and any electrode 221, 222 . . . 22n which is not energized with −300 VDC. It is further noteworthy that no electrostatic charge point will be formed on the copy sheet 24 if the voltage of +300 VDC is not applied to the auxiliary electrode 23, even if one or more of the electrodes 221, 222 . . . 22n are energized with −300 VDC. This is because a potential difference of |300 VDC| across the copy sheet 24 is insufficient to form an electrostatic charge point where a potential difference of |600 VDC| is sufficient to form an electrostatic charge point.

The electrodes 221, 222 . . . 22n may be energized in several ways in accordance with the prior art. In one method voltages of −300 VDC are applied to the selected electrodes 221, 222 . . . 22n simultaneously while the auxiliary electrode 23 is energized with +300 VDC. In another method, the selected electrodes 221, 222 . . . 22n are energized sequentially with −300 VDC while the auxiliary electrode 23 is maintained energized with +300 VDC. The first method results in uneven printing density as will be described in detail hereinbelow. The second method avoids uneven printing density but is very slow.

The electrodes 221, 222 . . . 22n which are energized with −300 VDC and the resulting electrostatic charge pattern formed on the copy sheet 24 correspond to a single scan line of an original document. In a facsimile transceiver or electrostatic copying machine, a single line of the original document is scanned by a linear photosensor array (not shown) to produce data signals which cause energization of certain of the electrodes 221, 222 . . . 22n. In a data processing apparatus the output signals of a central processing unit or the like are converted by a character generator (not shown) into data signals corresponding to an image pattern. This operation corresponds to one horizontal scan.

After a single scan line is processed to produce an electrostatic charge pattern on the copy sheet 24, the copy sheet 24 is moved in a direction perpendicular to the array 22 (into or out of the plane of the drawing) by one increment. Then, an electrostatic pattern of the next scan line is formed on the copy sheet 24. This operation is repeated until an electrostatic charge pattern corresponding to an image of an entire original document is formed on the copy sheet 24. Movement of the copy sheet 24 relative to the array 22 corresponds to vertical scan.

Then, a toner substance is applied to the copy sheet to form a toner image through electrostatic attraction in a well known manner. The toner image resulting from this operation is fixed to the copy sheet 24 to form a permanent reproduction of the original document.

Figure 1:
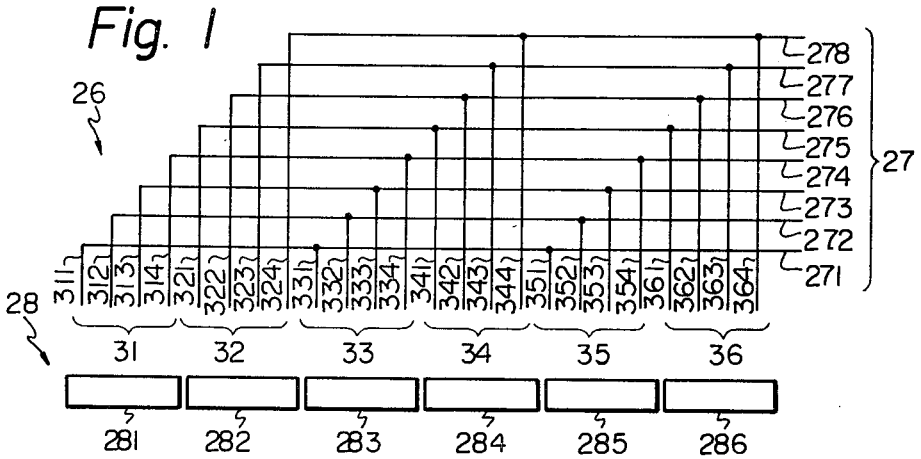
FIG. 1 is a schematic view of an electrostatic printing apparatus embodying the present invention.

FIG. 1 shows anothr electrostatic printing apparatus 26 which is designed to increase printing speed and reduce the number of connecting wires. It will be understood that in the apparatus 21 a separate wire must be provided to each electrode 221, 222 . . . 22n for connection to a suitable unit for energization thereof. In practical application for printing on ISO A4 size paper, a printing electrode density of 8 electrodes per millimeter or a total of 2400 electrodes are provided. It is extremely difficult and expensive to fabricate so many connecting wires in such a small space. For this reason, a bus line arrangement in combination with a plurality of auxiliary electrodes are preferably provided in actual practice as shown in FIG. 1.

Figure 3:
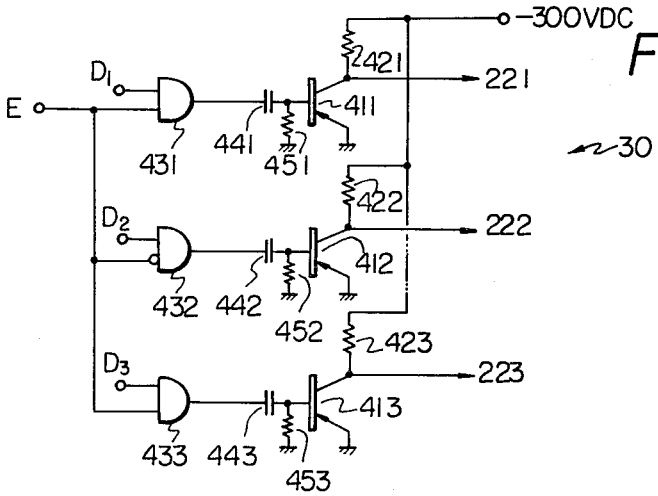
FIG. 3 is an electrical schematic diagram illustrating a drive circuit for printing electrodes.

The apparatus 26 comprises a set of 8 bus lines which is generally designated as 27. The individual bus lines are designated as 271, 272 . . . 278 respectively. The bus lines 27 are connected to a suitable drive unit such as shown in FIG. 3 and designated as 30 for applying a voltage of −300 VDC to selected ones of the bus lines 271, 272 . . . 278.

The apparatus 26 further comprises 6 auxiliary electrodes which are collectively designated as 28 and individually designated as 281, 282 . . . 286 respectively. These electrodes 28 extend linearly adjacent to 6 sets of printing electrodes which are designated as 31, 32 . . . 36 respectively. The individual electrodes of the electrode sets 31, 32 . . . 36 are designated by the number 1, 2, 3 or 4 suffixed to the number of the electrode set. For example, the individual electrodes of the set 31 are designated as 311, 312, 313, and 314 respectively. In other words, each electrode set 31, 32 . . . 36 comprises 4 individual electrodes.

The bus line 271 is connected to the electrodes 311, 331 and 351. The bus line 272 is connected to the electrodes 312, 332 and 352. The bus line 273 is connected to the electrodes 313, 333 and 353. The bus line 274 is connected to the electrodes 314, 334 and 354. The bus line 275 is connected to the electrodes 321, 341 and 361. The bus line 276 is connected to the electrodes 322, 342 and 362. The bus line 277 is connected to the electrodes 323, 343, and 363. The bus line 278 is connected to the electrodes 324, 344 and 364.

The apparatus 26 may be operated in several ways in accordance with the prior art. In the first method, the printing electrodes are energized sequentially. Initially, the printing electrodes 311, 312, 313 and 314 are sequentially selectively energized through the bus lines 271, 272, 273 and 274 while +300 VDC is applied only to the auxiliary electrode 281. Then, the printing electrodes 321, 322, 323 and 324 are sequentially selectively energized through the bus lines 275, 276, 277 and 278 while only the auxiliary electrode 282 is energized with +300 VDC. Then, the printing electrodes 331, 332, 333 and 334 are energized through the bus lines 271, 272, 273 and 274 in the same manner while the auxiliary electrode 283 is energized. The remaining printing electrodes and auxiliary electrodes are energized in an essentially similar manner until the entire line has been printed. It will be noted that the term "printing" is herein taken to mean printing or inducing an electrostatic charge pattern on the copy sheet 24.

In a practical printing apparatus which must operate at a reasonable speed, the length of time allowed for printing a single line has a limiting value t. Thus, all of the printing electrodes must be energized within the time period t. Where the printing electrodes are energized sequentially, the length of time each electrode may be energized is limited to t/N, where N is the number of electrodes. If t/N is too short, it will be impossible to print with sufficient density. Thus, it is desirable to energize more than one printing electrode at the same time.

One prior art method of increasing the printing density is by energizing all of the printing electrodes of each set 31, 32 . . . 36 simultaneously. In this case, the auxiliary electrodes 281 . . . 286 and corresponding electrode sets 31 . . . 36 are energized sequentially. Thus, the printing electrodes 311 . . . 314 will be initially selectively energized simultaneously while the auxiliary electrode 281 is energized. Then, the printing electrodes 321 . . . 324 will be energized selectively while the auxiliary electrode 282 is energized. The process is continued until the entire line has been printed. This expedient increases the length of time each printing electrode is energized by a factor of 4. The length of time each printing electrode is energized is equal to t/P, where P is the number of auxiliary electrodes 28.

The length of time the printing electrodes are energized may be yet further increased by simultaneously selectively energizing all of the bus lines 271 . . . 278 and two corresponding auxiliary electrodes. For example, the printing electrodes 311 . . . 314 and 321 . . . 324 are selectively energized in simultaneity with energization of the auxiliary electrodes 281 and 282. Then, the printing electrodes 331 . . . 334 and 341 . . . 344 are energized in simultaneity with energization of the auxiliary electrodes 283 and 284. Finally, the printing electrodes 351 . . . 354 and 361 . . . 364 are energized along with the auxiliary electrodes 285 and 286. In this case, the length of time the printing electrodes are energized is increased by a factor of 8 and is equal to t/M, where M is the number of printing electrodes connected to each bus line 271 . . . 278, or 3 in this example.

It will be noted that although there are 24 printing electrodes, the number of connecting wires is only 14 (eight bus lines 27 + six wires (not shown) connected to the auxiliary electrodes 28 respectively).

It is also possible to operate the apparatus 26 in such a manner that two auxiliary electrodes 28 and four printing electrodes are selectively energized simultaneously. For example, the auxiliary electrodes 281 and 282 may be energized along with the printing electrodes 313, 314, 321 and 322. Next, the auxiliary electrodes 282 and 283 are energized along with the printing electrodes 323, 324, 331 and 332, etc.

In accordance with the prior art, the greater the number of adjacent printing electrodes which are selectively energized at the same time, the greater the length of time each printing electrode is energized, assuming that the total line scanning time is fixed. Where the limiting parameter is the length of time each printing electrode must be energized, the greater the number of printing electrodes energized simultaneously, the greater the printing speed. In either case, an increase in the number of printing electrodes energized at the same time results in a decrease in the number of connecting wires required.

However, this expedient results in unevenness of printing density. This is because the electrostatic charge induced or printed on a particular point on the copy sheet 24 depends not only on the voltage applied to the printing electrode immediately facing said point but also on the voltages applied to the printing electrodes closely adjacent to said printing electrode. For example, if said printing electrode is energized and all of the adjacent printing electrodes are not energized, the induced electrostatic charge on said point will have a certain value. However, if said printing electrode and all of the adjacent printing electrodes are energized, the induced electrostatic charge and thereby the toner image density will be higher.

Conversely, if said printing electrode is not energized and all of the adjacent printing electrodes are energized, the electrostatic charge induced on said point will not be zero, which is the desired value, but will have a non-zero value. In summary, the electrostatic charge induced on a certain point on the copy sheet varies in accordance with the voltages on several adjacent printing electrodes. This results in an uneven or distorted toner image density distribution in the finished copy.

The manner in which this problem is overcome will become clear from the following description with reference again being made to FIG. 2. In accordance with the present invention, the printing electrodes are divided into 2 sets. The first set consists of all of the odd numbered printing electrodes 221, 223, 225, 227, 229 . . . . The second set consists of all of the even numbered printing electrodes 222, 224, 226, 228 . . . . It will be noted that the two sets of printing electrodes lie in two parallel rows which are in this case colinear. The printing electrodes of the second set are alternatingly spaced from the printing electrodes of the first set in a direction parallel to the rows, which in the drawing of FIG. 2 is the left-right direction.

Figure 4:
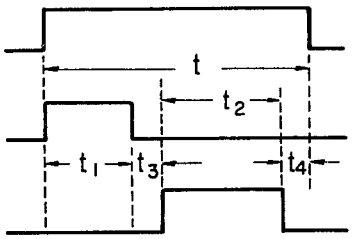
FIG. 4 is a timing diagram illustrating the present invention.

As shown in FIG. 4, the auxiliary electrode 23 is energized for the time period t described above. During a first time period tl starting at the beginning of the time period t, the selected ones of the first printing electrodes 221, 223, 225, 227 . . . are energized simultaneously. Then, during a subsequent time period t2, the selected ones of the second printing electrodes 222, 224, 226, 228 . . . are energized simultaneously. Preferably, a time period t3 is provided between the time periods t1 and t2 during which no printing electrodes are energized, although the time periods t1 and t2 may overlap. A corresponding time period t4 is provided following the time period t2 during which time no printing electrodes are energized.

This arrangement ensures even printing density since the two printing electrodes immediately adjacent to a certain printing electrode are always de-energized during a time period when said printing electrode is energized (or not energized) for printing. Where said printing electrode is to be energized to form an electrostatic charge point on the copy sheet 24 corresponding to a dark area of the original document, the induced electrostatic charge will always have a predetermined value since the two adjacent printing electrodes will always be de-energized. Consequently, when said printing electrode is not energized corresponding to a light area of the original document, the induced electrostatic charge will be substantially zero as desired. In other words, any given printing electrode is always influenced by the two neighboring printing electrodes in a predetermined manner since the two neighboring printing electrodes are always de-energized when said printing electrode is used for printing. In this manner, even printing density is ensured and density distortion is eliminated.

As viewed in FIG. 3, the drive unit 30 comprises n PNP transistors, only three being shown, which are designated as 411, 412, 413 . . . 41n and have collectors connected to the printing electrodes 221, 222, 223 . . . 22n respectively. The emitters of the transistors 411 . . . 44n are grounded and the collectors thereof are further connected to a −300 VDC voltage source through resistors 421, 422, 423 . . . 42n respectively.

The outputs of AND gates 431, 432, 433 . . . 43n are connected through coupling capacitors 441, 442, 443 . . . 44n to the bases of the transistors 421, 422, 423 . . . 42n, said bases also being connected to ground through resistors 451, 452, 453 . . . 45n respectively.

Data signals D1, D2, D3 . . . Dn corresponding to the individual data points in a particular scan line are applied to inputs of the AND gates 431, 432, 433 . . . 43n respectively. A control signal E is applied to non-inverting inputs of the odd-numbered AND gates 431, 433, 435, 437 . . . and to inverting inputs of the even-numbered AND gates 432, 434, 436, 438 . . . .

The data signals D1, D2, D3 . . . are applied to all of the AND gates 431, 432, 433 . . . 43n respectively during the time period tl and again during the time period t2. Means not shown inhibit the data signals during the time periods t3 and t4. The control signal E is logically high during the time periods tl and t3 and is logically low during the time periods t2 and t4. Thus, the odd-numbered AND gates 431, 433, 435, 437 . . . are enabled to pass the odd-numbered data signals D1, D3, D5, D7 . . . to the odd-numbered transistors 411, 413, 415, 417 .

. . during the time period tl. The even-numbered AND gates 432, 434, 436, 438 . . . are enabled to pass the even numbered data signals D2, D4, D6, D8 . . . to the even-numbered transistors 422, 424, 426, 428 . . . during the time period t2.

A logically high data signal turns off the corresponding transistor, causing the −300 VDC voltage to be applied to the respective printing electrode. A logically low data signal turns on the corresponding transistor, grounding the respective printing electrode. It will be further noted that when the control signal E inhibits any of the AND gates illustrated in FIG. 3, the resulting low output of the AND gate turns on the corresponding transistor to ground the respective printing electrode.

The present invention may also be applied to the apparatus 26. Preferably, the auxiliary electrodes 281 and 282 will be energized first. At the same time, the printing electrodes 311, 313, 321 and 323 will be selectively energized. Then, while maintaining the auxiliary electrodes 281 and 282 energized, the printing electrodes 312, 314, 322 and 324 will be selectively energized. The auxiliary electrodes 283 and 284 will then be energized along with the corresponding printing electrodes in an essentially similar manner. Finally, the auxiliary electrodes 285 and 286 will be energized along with the corresponding printing electrodes. This arrangement provides a printing speed which is 4 times faster than sequential energization of the printing electrodes in conjunction with a toner image which is even and free density distortion.

Figure 5:
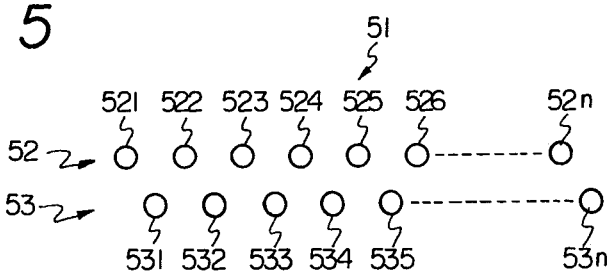
FIG. 5 is a schematic view of another electrode arrangement.

FIG. 5 illustrates another apparatus 51 in accordance with the present invention comprising first and second sets of printing electrodes 52 and 53 respectively. The individual printing electrodes of the set 52 are designated as 521, 522, 523 . . . 52n and the individual printing electrodes of the set 53 are designated as 531, 532, 533 . . . 53n respectively. It will be noted that the printing electrodes of the first set 52 are alternatingly spaced relative to the printing electrodes of the second set 53 in the direction parallel to the rows, in FIG. 5 the left-right direction. In addition, the sets 52 and 53 define two rows which are spaced from each other perpendicular to said direction, or in the direction of movement of the copy sheet 24. In this Figure the copy sheet 24 may be moved either upwardly or downwardly. In the apparatus 51 the selected printing electrodes of the set 52 are energized simultaneously during the time period tl and the selected printing electrodes of the set 53 are simultaneously energized during the time period t2.

Figure 6:
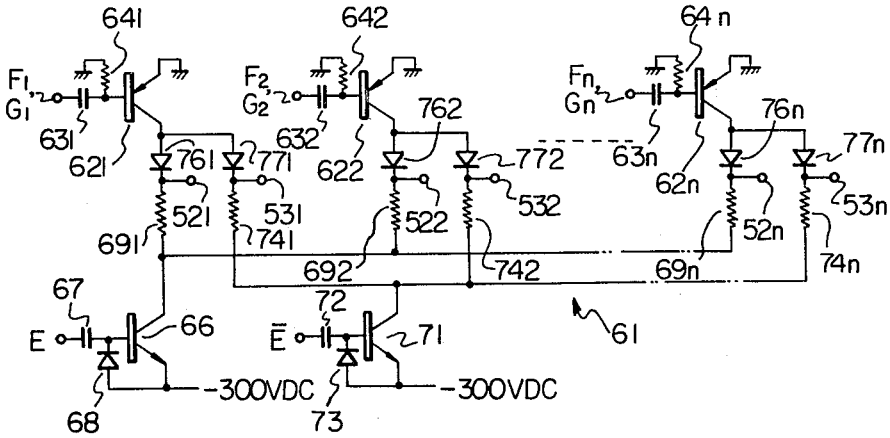
FIG. 6 is an electrical schematic diagram illustrating a drive circuit for the electrode arrangement of FIG. 5.

FIG. 6 shows a drive unit 61 which is illustrated as being connected to drive the apparatus 51 but which may be adapted to drive the apparatus 21. In this case, the −300 VDC voltage supply is gated rather than the data signals.

The drive unit 61 comprises PNP transistors 621, 622 . . . 62n having bases connected to receive data signals (F1, G1), (F2, G2) . . . (Fn, Gn) through coupling capacitors 631, 632 . . . 63n respectively. The emitters of the transistors 621, 622 . . . 62n are grounded and the bases thereof also grounded through resistors 641, 642 . . . 64n respectively.

The control signal E is applied to the base of an NPN transistor 66 through a coupling capacitor 67. The emitter of the transistor 66 is connected to the −300 VDC source. The anode of a diode 68 is connected to the emitter of the transistor 66, the cathode of the diode 68 being connected to the base of the transistor 66. The collector of the transistor 66 is connected through resistors 691, 692 . . . 69n to the printing electrodes 521, 522 . . . 52n respectively.

The inversion $\bar{E}$ of the control signal E is applied to the base of an NPN transistor 71 through a coupling transistor 72. The emitter of the transistor 71 is connected to the −300 VDC source. The anode of a diode 73 is connected to the emitter of the transistor 71, the cathode of the diode 73 being connected to the base of the transistor 71. The collector of the transistor 71 is connected through resistors 741, 742 . . . 74n to the printing electrodes 531, 532 . . . 53n respectively.

The collectors of the transistors 621, 622 . . . 62n are connected to the anodes of diodes 761, 762 . . . 76n, the cathodes of which are connected to the printing electrodes 521, 522 . . . 52n respectively. The collectors of the transistors 621, 622 . . . 62n are also connected to the anodes of diodes 771, 772 . . . 77n, the cathodes of which are connected to the printing electrodes 531, 532 . . . 53n respectively.

In operation, a logically high control signal E is applied to the transistor 66 to turn on the same. This high control signal E turns off the transistor 71. As will be understood from further discription, the high control signal E which is applied during the time t1 enables the printing electrodes 52.

Simultaneously, the data signals F1, F2 . . . Fn for the printing electrodes 521, 522 . . . 52n are supplied to the transistors 621, 622 . . . 62n respectively. A high data signal F1, F2 . . . Fn will turn off the corresponding transistor 621, 622 . . . 62n so that the −300 VDC voltage is applied to the corresponding printing electrode 521, 522 . . . 52n through the respective resistor 691, 692 . . . 69n. A low data signal F1, F2 . . . Fn turns on the corresponding transistor 621, 622, 62n and grounds the corresponding printing electrode 521, 522 . . . 52n through the respective diode 761, 762 . . . 76n. Thus, it will be noted that the resistors 691, 692 . . . 69n and corresponding diodes 761, 762 . . . 76n constitute AND gates.

During the time period t2 the control signal E is made logically low to turn on the transistor 71 and turn off the transistor 66. This enables the printing electrodes 53. The data signals G1, G2 . . . Gn for the printing electrodes 531, 532 . . . 53n are applied to the transistors 621, 622 . . . 62n. In this case, the resistors 741, 742 . . . 74n and diodes 771, 772 . . . 77n constitute AND gates for the printing electrodes 531, 532 . . . 53n which are enabled through turning on of the transistor 71. Thus, logically high data signals G1, G2 . . . Gn will turn off the corresponding transistors 621, 622 . . . 62n to apply −300 VDC to the respective printing electrodes 531, 532 . . . 53n and vice-versa in the same manner described above.

The arrangement of FIG. 6 is especially advantageous since it enables the number of high voltage switching transistors 621, 622 . . . 62n to be reduced by a factor of two (excluding the transistors 66 and 71), the transistors 621, 622 . . . 62n being used for both electrode sets 52 and 53.

Figure 7:
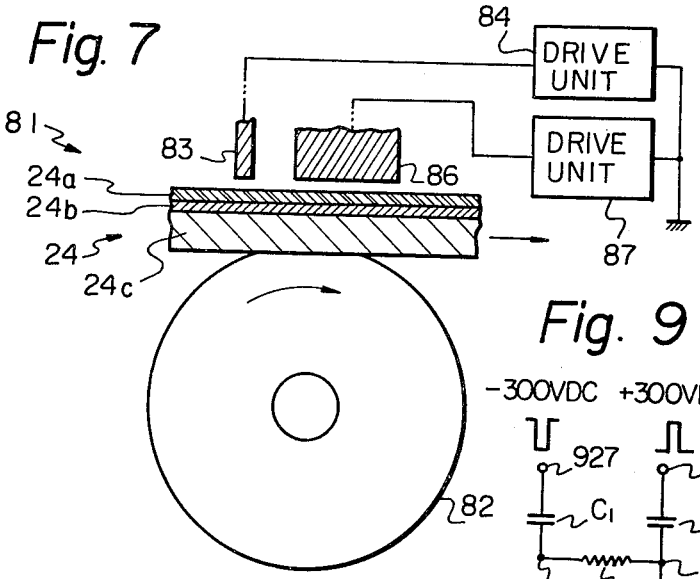
FIG. 7 is a schematic view illustrating another electrode arrangement.

Although in the embodiments shown and described thus far the copy sheet has been moved between the printing electrodes and auxiliary electrodes, it is also possible within the scope of the present invention to provide another arrangement which is illustrated in FIG. 7. In an apparatus 81 the copy sheet 24 is formed with an upper dielectic layer *24a*, an intermediate electrically conductive layer *24b* and a lower substrate layer *24c*. The copy sheet 24 is moved rightwardly by an elastic rubber feed roller 82. A set of printing electrodes 83 energized by a drive unit 84 is disposed adjacently above the copy sheet 24. A set of auxiliary electrodes 86 energized by a drive unit 87 is disposed also above the copy sheet 24 adjacent to the printing electrode set 83 and downstream thereof in the direction of movement of the copy sheet 24. Although the electrostatic field is applied to the copy sheet 24 in the apparatus 81 in a different manner than in the above embodiments, the basic method of practicing the present invention is the same. Any of the methods described hereinabove may be applied to the apparatus 81.

Figure 9:
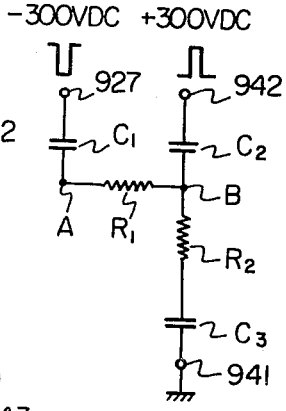
FIG. 9 shows an electrical equivalent circuit of a printing electrode arrangement.

Although the embodiments thus far disclosed eliminate unevenness in printing density due to the influence of adjacent printing electrodes, it has been noticed in actual practice that the printing density of the second set of printing electrodes (the set which is subsequently energized) is less than that of the first set of printing electrodes (which is energized first). The reason for this phenomenon is illustrated in FIGS. 8 and 9.

Figure 8:
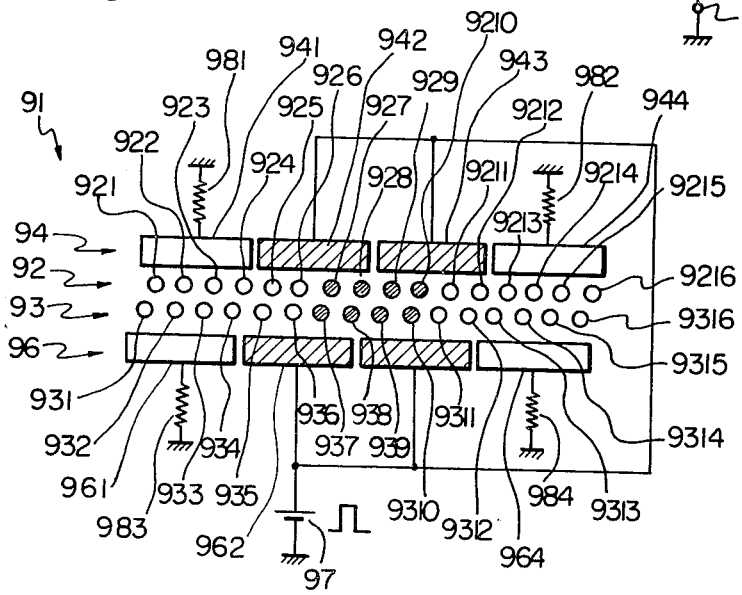
FIG. 8 is a schematic view illustrating yet another electrode arrangement.

FIG. 8 illustrates an apparatus 91 in which first and second sets of printing electrodes 92 and 93 are provided in the same manner as in the apparatus 51 shown in FIG. 5. However, in the apparatus 91 two sets of auxiliary electrodes, designated as 94 and 96, are provided adjacent to the printing electrodes 92 and 93 respectively. The respective auxiliary electrodes 94 and 96 are arranged to be energized together.

The individual printing and auxiliary electrodes are designated by reference numerals in such a manner that the number indicating the position of the individual electrode is suffixed to the number of the electrode set. For example, the printing electrode in the 12th position in the printing electrode set 93 is designated as 9312.

As illustrated, a positive pulse of +300 VDC is applied to the auxiliary electrodes 942, 943, 962 and 963 during the time periods t1 and t2 from a power source 97. Negative pulses of −300 VDC are applied to the printing electrodes 927, 928, 929 and 9210 during the time period t1 and to the printing electrodes 937, 938, 939 and 9310 during the time period t2.

FIG. 9 illustrates an equivalent circuit comprising the printing electrode 927, auxiliary electrode 942 and auxiliary electrode 941. The auxiliary electrodes 941, 944, 961 and 964 are grounded through resistors 981, 982, 983 and 984 respectively.

The capacitance between the printing electrode 927 and a point A directly therebelow on the copy sheet 24 is designted as C1. The capacitance between the auxiliary electrode 942 and a point B directly therebelow on the copy sheet 24 is designated as C2. The resistance along the surface of the copy sheet 24 between the points A and B is designated as R1. The capacitance between the auxiliary electrode 941 and the surface of the copy sheet 24 is designated as C3. The resistance along the surface of the copy sheet 24 measured from below the auxiliary electrode 941 to the point B is indicated as R2.

Indicated as V3 is the effective voltage applied to the copy sheet 24 by the auxiliary electrode 942. The effective electrostatic potential acting on the copy sheet 24 to form an electrostatic charge thereon is indicated as V4. Voltages V1 and V12 are applied to the printing electrode sets 92 and 93 for printing.

Figure 11:
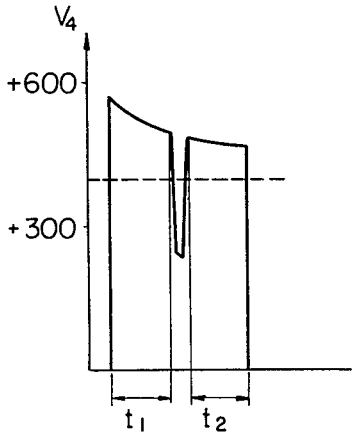

It will be seen that the voltage V3 decreases as a function of time. The voltage V4 which generally corresponds to the algebraic sum of the voltages V1 or V2 in combination with the voltage V3 also decreases with time as indicated in FIG. 11. The reason for this appears to be that the potential at the point B is dissipated to ground through the resistance R2 and capacitance C3. As a result, the effective potential V4 available for forming an electrostatic charge on the copy sheet 24 during the time t2 is less than during the time t1. Thus, the printing electrode set 93 will produce less image density than the printing electrode set 92.

Figure 10:
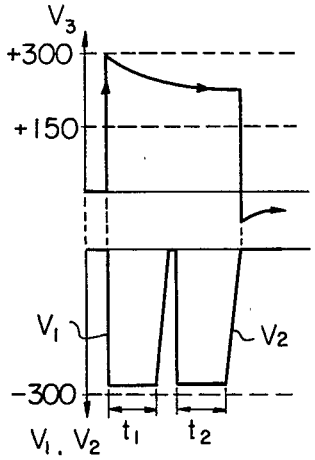
FIGS. 10 and 11 are graphs illustrating a problem which has existed heretofore in the prior art.
Figure 12:
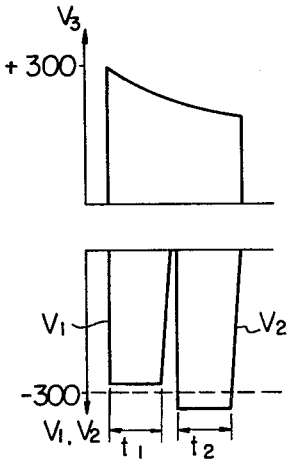
FIGS. 12, 13 and 14 are graphs illustrating how to overcome the prior art problem in accordance with the present invention.

This problem may be overcome in accordance with the present invention in several ways. As shown in FIG. 12, the time periods t1 and t2 are made equal. However, the voltage V2 is made larger than the voltage V1 to compensate for the charge dissipation illustrated in FIGS. 10 and 11.

Figure 13:
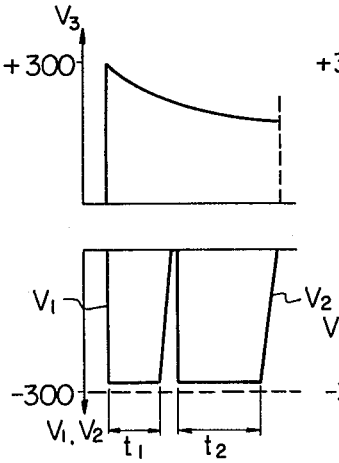
Figure 14:
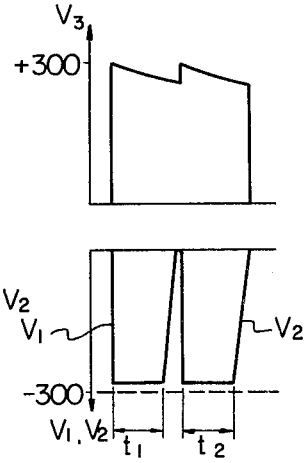

Alternatively, as shown in FIG. 13, the voltages V1 and V2 may be made equal but the time period t2 may be made longer than the time period t1. As yet another alternative, illustrated in FIG. 14, the voltages V1 and V2 may be made equal and the time periods t1 and t2 also be made equal. However, in this case, the level of the voltage applied to the auxiliary electrode 942 from the source 97 is increased during the time period t2. For example, the applied voltage may be +300 VDC during the time period t1 and +400 VDC during the time period t2.

In summary, it will be seen that the present invention provides an electrostatic printing apparatus which overcomes the drawbacks of the prior art and eliminates uneven and distorted density distributions while maintaining high printing speed and resolution. Various modifications will become possible for those skilled in the art after receiving the teachings of the present disclosure without departing from the scope thereof. For example, it is possible to alternatingly energize the printing electrodes in such a manner that more than one adjacent printing electrode on each side of a printing electrode being used for printing is de-energized.

What we claim is:

1. An electrostatic printing apparatus comprising:

a plurality of first printing electrodes arranged in a first row; and a plurality of second printing electrodes arranged in a second row adjacent to the first printing electrodes, the second printing electrodes being alternatingly spaced from the first printing electrodes in a direction parallel to the first and second rows in such a manner that each first printing electrode is spaced between two adjacent second printing electrodes and vice-versa, characterized by comprising:

drive means for selectively energizing the first and second printing electrodes to form a linear electrostatic pattern on a printing medium disposed adjacent to the first and second printing electrodes, the drive means being constructed to energize selected first printing electrodes during a first time period and subsequently energize selected second printing electrodes during a second time period, the first and second rows being colinear.

2. An apparatus as in claim 1, further comprising an auxiliary electrode disposed adjacent to the first and second printing electrodes, the drive means energizing the auxiliary electrode during the first and second time periods.

3. An apparatus as in claim 1, further comprising a plurality of first AND gate means having outputs connected to the first printing electrodes respectively and a plurality of second AND gate means having outputs connected to the second printing electrodes respectively, inputs of first and second AND gate means in corresponding positions being connected together to receive respective data signals corresponding to the electrostatic pattern, other inputs of all of the first AND gate means being connected together to receive a first voltage during the first time period, other inputs of all of the second AND gate means being connected together to receive a second voltage during the second time period.

4. An electrostatic printing apparatus comprising:

a plurality of first printing electrodes arranged in a first row; and a plurality of second printing electrodes arranged in a second row adjacent to the first printing electrodes, the second printing electrodes being alternatingly spaced from the first printing electrodes in a direction parallel to the first and second rows in such a manner that each first printing electrode is spaced between two adjacent second printing electrodes and vice-versa, characterized by comprising:

drive means for selectively energizing the first and second printing electrodes to form an electrostatic pattern on a printing medium disposed adjacent to the first and second printing electrodes, the drive means being constructed to energize selected first printing electrodes during a first time period and subsequently energize selected second printing electrodes during a second time period, the second time period being longer than the first time period.

5. An apparatus as in claim 4, in which the drive means is constructed to energize the selected first and second printing electrodes with a same voltage.

6. An electrostatic printing apparatus comprising:

a plurality of first printing electrodes arranged in a first row; and a plurality of second printing electrodes arranged in a second row adjacent to the first printing electrodes, the second printing electrodes being alternatingly spaced from the first printing electrodes in a direction parallel to the first and second rows in such a manner that each first printing electrode is spaced between two adjacent second printing electrodes and vice-versa, characterized by comprising:

drive means for selectively energizing the first and second printing electrodes to form an electrostatic pattern on a printing medium disposed adjacent to the first and second printing electrodes, the drive means being constructed to energize selected first printing electrodes during a first time period and subsequently energize selected second printing electrodes during a second time period, the drive means being constructed to energize the selected first printing electrodes with a first voltage and to energize the selected second printing electrodes with a second voltage which is higher than the first voltage.

7. An apparatus as in claim 6, in which the first and time periods are equal.

8. An electrostatic printing apparatus comprising:

a plurality of first printing electrodes arranged in a first row; and a plurality of second printing electrodes arranged in a second row adjacent to the first printing electrodes, the second printing electrodes being alternatingly spaced from the first printing electrodes in a direction parallel to the first and second rows in such a manner that each first printing electrode is spaced between two adjacent second printing electrodes and vice-versa, characterized by comprising:

drive means for selectively energizing the first and second printing electrodes to form an electrostatic pattern on a printing medium disposed adjacent to the first and second printing electrodes, the drive means being constructed to energize selected first printing electrodes during a first time period and subsequently energize second printing electrodes during a second time period; and an auxiliary electrode disposed adjacent to the first and second printing electrodes, the drive means energizing the auxiliary electrode during the first and second time periods;

the drive means being constructed to energize the auxiliary electrode with a first voltage during the first time period and with a second voltage which is higher than the first voltage during the second time period.

9. An apparatus as in claim 4, 5, 6, 7 or 8, in which the second row is spaced from the first row in a direction perpendicular to said direction.

10. An apparatus as in claim 4, 5, 6, 7 or 8, in which the first and second rows are colinear.

* * * * *